United States Patent [19]

Aoki

[11] 4,102,022

[45] Jul. 25, 1978

[54] AUTOMATICALLY LOCKING SLIDER FOR SLIDE FASTENERS

[75] Inventor: Tsunetaka Aoki, Kamiichi, Japan

[73] Assignee: Yoshida Kogyo K.K., Japan

[21] Appl. No.: 845,624

[22] Filed: Oct. 26, 1977

[30] Foreign Application Priority Data

Oct. 26, 1976 [JP] Japan ..... 51-143978[U]

[51] Int. Cl.[2] ..... A44B 19/30

[52] U.S. Cl. ..... 24/205.14 R

[58] Field of Search ..... 24/205.14 R, 205.14 K

[56] References Cited

U.S. PATENT DOCUMENTS 2,511,491 6/1950 Brown ..... 24/205.14 R 3,813,736 6/1974 Fukuroi ..... 24/205.14 R

*Primary Examiner*—Bernard A. Gelak

*Attorney, Agent, or Firm*—Bucknam and Archer

[57] ABSTRACT

A pull tab releasable slider lock mechanism includes a leaf spring supported within a cover, which is fixedly mounted on the slider body, by having its opposite ends engaged in recesses formed in the opposed inside surfaces of the cover. A part of this leaf spring is formed into a resilient tongue which is engaged with a locking member to normally bias its terminal pawl into the guide channel in the slider body. In another embodiment, the resilient tongue of the leaf spring is integrated with the locking pawl, thereby dispensing with the separate locking member.

5 Claims, 2 Drawing Figures

AUTOMATICALLY LOCKING SLIDER FOR SLIDE FASTENERS

BACKGROUND OF THE INVENTION

1. Field of the Invention

This invention relates to slide fasteners, and in particular to improvements in an automatically locking slider for slide fasteners, that is, a slider having a pull tab releasable lock mechanism operable to lock the slider against movement in any desired position on the interlocking rows of fastener elements or scoops when there is no pull on the pull tab.

2. Description of the Prior Art

One well known type of pull tab releasable slider lock mechanism comprises a locking pawl, a leaf spring normally biasing the locking pawl into the guide channel in the slider body, and a cover enclosing such working parts. The locking pawl may be an integral part of a locking member pivotally mounted on the slider body, or of the leaf spring itself. The leaf spring may also be formed integral with the locking member.

Automatically locking sliders of this type permit comparatively easy assemblage in the case where the locking member or its equivalent part is mounted on the slider body by means of a pivot pin or the like. A problem arises, however, if the slider body is manufactured by a press or like machine and has no supporting projections formed thereon. The assemblage of the slider is then highly troublesome and time-consuming because the leaf spring and the locking member or the like must be held in position by the cover and, consequently, because these parts have no supporting means until the cover is finally attached to the slider body. A machine of complex construction is therefore required for automatic assemblage of such sliders.

SUMMARY OF THE INVENTION

It is an object of this invention to provide an improved automatically locking slider of the class under consideration which permits ready assemblage and which is positive and reliable in operation.

In accordance with this invention, briefly summarized, there is provided an automatically locking slider comprising a cover fixedly mounted on the slider body and a leaf spring supported within the cover by having its opposite ends urged against the opposed inside surfaces of the cover under its own resiliency. A part of this leaf spring is formed into a resilient tongue normally biasing a locking pawl into the guide channel in the slider body. The slider further includes a pull tab which, when pulled, is capable of retracting the locking pawl away from the guide channel in the slider body against the bias of the resilient tongue of the leaf spring.

In one preferred embodiment of the invention, the locking pawl is formed at one end of a locking member placed upon the slider body, and in another embodiment, the locking pawl is integrated with the resilient tongue of the leaf spring. In either case, since the leaf spring together with the resilient tongue can be supported directly by and within the cover, either before or after being mounted on the slider body, the slider can be assembled through a materially simplified procedure.

The above and other objects, features and advantages of this invention and the manner of attaining them will become more readily apparent, and the invention itself will best be understood, as the description proceeds, with reference had to the accompanying drawings showing the preferred embodiments of the invention.

DESCRIPTION OF THE PREFERRED EMBODIMENTS

Figure 1:
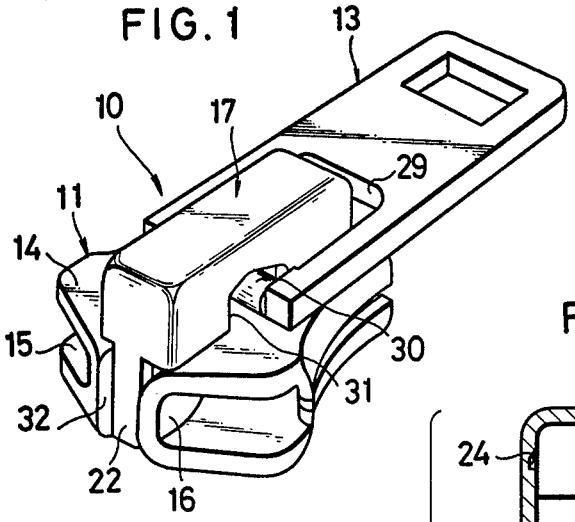
FIG. 1 is a perspective view of the automatically locking slider constructed in accordance with this invention.

FIGS. 1 through 4 of the drawings illustrate one of the preferred embodiments of this invention. With reference first and in particular to FIGS. 1 and 2, the illustrated automatically locking slider is generally designated 10 and is shown to comprise a body 11, an automatic lock mechanism 12 mounted on the slider body for locking the slider against movement in either direction on interlocking rows of fastener elements or scoops, not shown, and a pull tab 13 pivotally mounted on the slider body and operatively associated with the automatic lock mechanism.

The slider body 11 comprises top and bottom wings or plate members 14 and 15 and a neck 16 integrally connecting the wings at their flared front ends so as to define the usual Y-shaped guide channel for the unshown rows of fastener elements.

The automatic lock mechanism 12 comprises a cover 17 fixedly mounted on the slider body 11, a leaf spring 18 mounted within the cover and having a resilient tongue 19, and a locking member 20 having a terminal pawl 21 normally biased by the resilient tongue of the leaf spring into the guide channel in the slider body for interference contact with the unshown rows of fastener elements.

Figure 3:
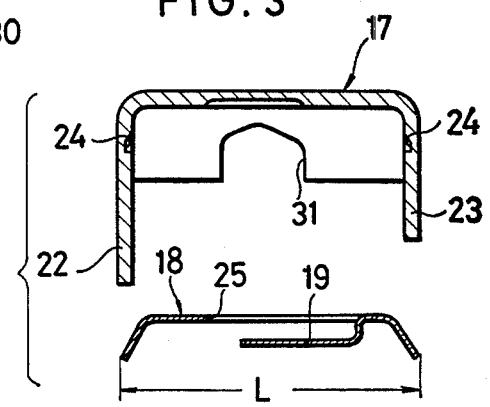
FIG. 3 is a similar view showing the leaf spring and the cover separated.
Figure 2:
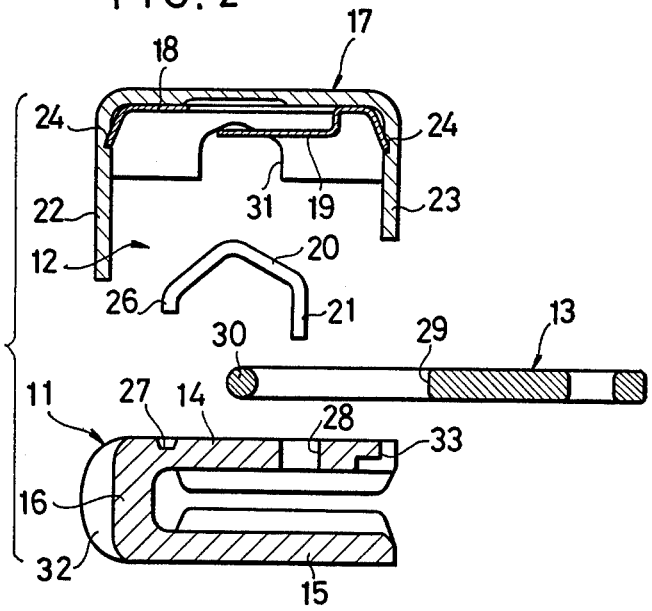
FIG. 2 is a longitudinal axial sectional view showing the various parts of the slider of FIG. 1 separated but with the leaf spring mounted in position within the cover.

As will be seen also from FIG. 3, the cover 17 is box-like in shape, having a closed top and an open bottom, and is provided with front and rear legs 22 and 23 extending downwardly therefrom which are intended for use in securing the cover to the slider body 11. The cover 17 has recesses 24 formed in the opposed inside surfaces of its front and rear walls for engaging the opposite ends of the leaf spring 18 and thus for securely holding same within the cover.

In the form of a strip of sheet metal, the leaf spring 18 has its opposite end portions angled downwardly, and the length L of this leaf spring is made slightly more than the distance between the pair of recesses 24 in the opposed inside surfaces of the cover 17. The leaf spring 18 has a cut 25 formed in its mid-portion to provide the resilient tongue 19 which is bent into the shape of an L for engaging the locking member 20.

The locking member 20 is in the shape of an inverted V, terminating at its front end in a downwardly extending leg 26 of comparatively short extent for engagement in a depression 27 formed in the top wing 14 of the slider body 11. At its rear end the locking member 20 terminates in the locking pawl 21 extending downwardly so as to project normally into the guide channel in the slider body 11 through an aperture 28 formed in the slider body top wing 14.

The pull tab 13 has an aperture 29 of substantially rectangular shape formed adjacent one end thereof, and this end of the pull tab is formed into a pivot pin portion 30 of circular cross section about which the pull tab is pivotable. In the assembled slider 10 (FIGS. 1 and 4), the pivot pin portion 30 of the pull tab 13 loosely extends through recesses 31 formed in the opposed side walls of the cover 17.

For assembling the automatically locking slider 10 of the foregoing construction, the leaf spring 18 is first forced into the cover 17, and its opposite ends are engaged in the respective recesses 24 in the front and rear walls of the cover, in such a way that the major portion of the leaf spring is held in close contact with the inside surface of the top wall of the cover. The pivot pin portion 30 of the pull tab 13 is then placed in position upon the slider body top wing 14, and the locking member 20 is then placed astraddle the pivot pin portion, as will be apparent from FIG. 4. The mounting of the locking member 20 on the slider body 11 can be completed as its leg 26 is engaged in the depression 27 in the slider body top wing 14 and as its pawl 21 is inserted into and through the aperture 28 in the slider body top wing.

Figure 4:
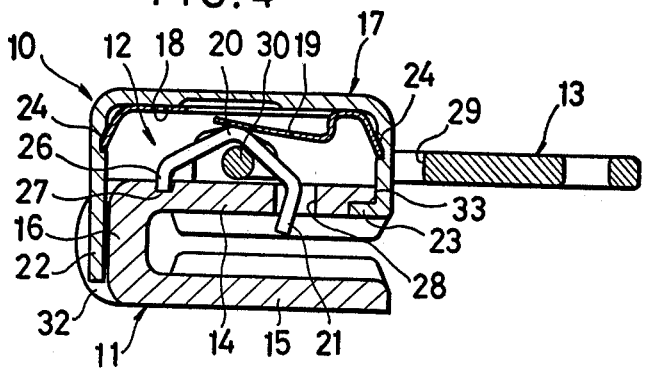
FIG. 4 is a longitudinal axial sectional view of the slider of FIG. 1 in assembled form.

The cover 17 having the leaf spring 18, complete with the resilient tongue 19, mounted therein is then placed in position upon the slider body top wing 14 and is secured thereto in the following manner. The front leg 22 of the cover 17 is snugly engaged in a recess 32 formed in the slider body neck 16, and the rear leg 23 of the cover is fitted in an L-shaped recess 33 formed in the slider body top wing 14 at its rear end and is clinched as shown in FIG. 4.

In the thus-assembled automatically locking slider 10, the terminal pawl 21 of the locking member 20 is normally biased by the resilient tongue 19 of the leaf spring 18 into the guide channel in the slider body 11 for locking the slider against movement in either direction along the unshown rows of fastener elements in any desired position thereon. The slider 10 can of course be unlocked upon exertion of a pull on the pull tab 13, because then the locking pawl 21 is retracted away from the guide channel in the slider body against the bias of the resilient tongue 19.

It will have been understood from the foregoing that the automatically locking slider 10 in accordance with this invention can be assembled through a highly expeditious procedure, thanks largely to the fact that the leaf spring 18 complete with the resilient tongue 19 can be securely supported by and within the cover 17 during assemblage. As an additional advantage, since the leaf spring 18 is retained in position within the cover 17, its resilient tongue 19 can be held in proper engagement with the locking member 20 in the assembled slider, so that the automatic lock mechanism 12 of the slider is bound to function exactly in the intended manner in the complete slide fastener assembly.

Figure 5:
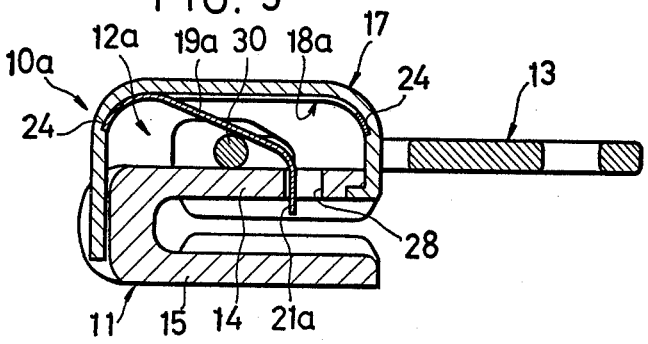
FIG. 5 is a longitudinal axial sectional view of another preferred embodiment of the invention.
Figure 6:
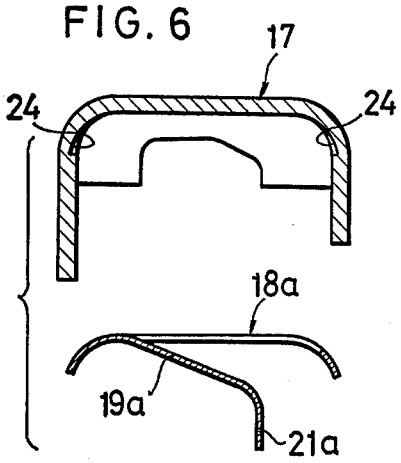
FIG. 6 is a longitudinal axial sectional view showing the leaf spring and cover of the slider of FIG. 5 separated.
Figure 7:
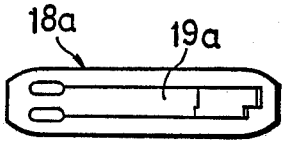
FIG. 7 is a plan view of the leaf spring of the slider of FIG. 5.

Another preferred embodiment of the invention shown in FIGS. 5 through 7 differs from the preceding embodiment in that the leaf spring is integrated with the locking pawl to dispense with the separate locking member and thus to make the assemblage of the slider still easier. The modified automatically locking slider is generally designated **10*a*, and its automatic lock mechanism 12*a*, in FIG. 5**.

As shown in FIGS. 5 and 6, the automatic lock mechanism **12*a* comprises the cover 17 which is constructed substantially like that of the preceding embodiment, and a leaf spring 18*a* supported directly by and within the cover. As will be seen also from FIG. 7, a part of the leaf spring 18*a* is formed into a resilient tongue 19*a* sloping downwardly as it extends rearwardly and terminating in a locking pawl 21*a*** bent downwardly from the rear end of the resilient tongue.

In the assembled slider **10*a*, the leaf spring 18*a* has its opposite ends engaged in the respective recesses 24 in the opposed inside surfaces of the front and rear walls of the cover 17, as in the preceding embodiment. The resilient tongue 19*a* of the leaf spring extends over the pivot pin portion 30 of the pull tab 13 lying upon the top wing 14 of the slider body 11, and the locking pawl 21*a* normally projects into the guide channel in the slider body through the aperture 28 under the bias of the resilient tongue. The other details of construction of the slider 10*a* are as set forth above in connection with FIGS. 1 through 4**, and the operation and advantages of this modified slider are also believed to be apparent from the description of the preceding embodiment.

Although the improved automatically locking slider of this invention has been shown and described in terms of its preferred forms, it is understood that the invention is not to be limited by the exact details of this disclosure but is inclusive of variations or modifications which will readily occur to those skilled in the art. For example, for supporting the leaf spring 18 or **18*a* within the cover 17**, projections may be formed on the opposed inside surfaces of the front and rear walls of the cover so as to engage the opposite ends of the leaf spring. Furthermore, if desired, neither recesses nor projections may be formed on the inside surfaces of the cover, and the leaf spring may be supported therein only by virtue of its own resiliency. These and other variations or equivalents are understood to fall within the scope of the invention as defined by the appended claims.

What is claimed is:

1. An automatically locking slider for slide fasteners comprising, in combination, a body defining a guide channel therein, a cover fixedly mounted on the slider body, a leaf spring supported within the cover by having its opposite ends urged against the opposed inside surfaces of the cover under its own resiliency, the leaf spring having a part thereof formed into a resilient tongue, a locking pawl normally biased by the resilient tongue of the leaf spring into the guide channel in the slider body, and a pull tab pivotally mounted on the slider body and adapted to move the locking pawl away from the guide channel in the slider body against the bias of the resilient tongue of the leaf spring upon exertion of a pull on the pull tab.

2. An automatically locking slider as recited in claim 1, wherein the cover has a recess formed in each of said opposed inside surfaces thereof, and wherein the leaf spring has its opposite ends engaged in the respective recesses.

3. An automatically locking slider as recited in claim 1, wherein the leaf spring is held in close contact with the inside surface of the top wall of the cover.

4. An automatically locking slider as recited in claim 1, wherein the pull tab has a pivot pin portion lying on the slider body, and wherein the locking pawl is formed at one end of a locking member which is placed astraddle the pivot pin portion of the pull tab and which is engaged with the resilient tongue of the leaf spring.

5. An automatically locking slider as recited in claim 1, wherein the pull tab has a pivot pin portion lying on the slider body, and wherein the locking pawl is formed at the end of the resilient tongue of the leaf spring which extends over the pivot pin portion of the pull tab.

* * * * *